US007184001B2

(12) United States Patent
Chen

(10) Patent No.: US 7,184,001 B2
(45) Date of Patent: Feb. 27, 2007

(54) METHOD AND APPARATUS FOR FRAME PROCESSING IN A LIQUID CRYSTAL DISPLAY

(75) Inventor: Li-Yi Chen, Nantou (TW)

(73) Assignee: CHI MEI Optoelectronics Corp., Tainan (TW)

( * ) Notice: Subject to any disclaimer, the term of this patent is extended or adjusted under 35 U.S.C. 154(b) by 399 days.

(21) Appl. No.: 10/630,906

(22) Filed: Jul. 31, 2003

(65) Prior Publication Data

US 2004/0041745 A1 Mar. 4, 2004

(30) Foreign Application Priority Data

Aug. 2, 2002 (TW) ..... 91117502 A

(51) Int. Cl.
*G09G 5/00* (2006.01)

(52) U.S. Cl. ..... 345/3.2; 345/94; 345/98

(58) Field of Classification Search ..... 345/3.2, 345/87, 98, 99, 204, 208, 94
See application file for complete search history.

(56) References Cited

U.S. PATENT DOCUMENTS 5,764,212 A * 6/1998 Nishitani et al. ..... 345/98
6,008,790 A * 12/1999 Shingu et al. ..... 345/98
6,014,126 A * 1/2000 Nishihara ..... 345/3.2
6,741,229 B1 * 5/2004 Yanagi et al. ..... 345/98
6,894,669 B2 * 5/2005 Suzuki et al. ..... 345/204
6,930,663 B2 * 8/2005 Sekiya et al. ..... 345/87
2002/0196224 A1 * 12/2002 Ham ..... 345/94
2003/0137527 A1 * 7/2003 Lin et al. ..... 345/99

* cited by examiner

*Primary Examiner*—Regina Liang
(74) *Attorney, Agent, or Firm*—Rabin & Berdo, P.C.

(57) ABSTRACT

A method of frame processing which includes the following steps: 1) an input frame is input into the frame processing device, 2) according to the input frame and the previous input frame, the frame processing device selects a multiple number of output frames, and 3) the output frames are output by the frame processing device at a refresh rate greater than the first refresh rate. When the voltage value of the input frame is greater than the previous frame's voltage value, the voltage value of the output frame is greater than that of the input frame. When the voltage value of the input frame is less than the previous one's, the voltage value of the output frame is less than that of the input frame.

28 Claims, 5 Drawing Sheets

METHOD AND APPARATUS FOR FRAME PROCESSING IN A LIQUID CRYSTAL DISPLAY

This application claims the benefit of Taiwan application Serial No. 91117502, filed on Aug. 2, 2002.

BACKGROUND OF THE INVENTION

1. Field of the Invention

The invention relates in general to a method for frame processing and an apparatus therefor, and more particularly to a method for frame processing in a liquid crystal display panel and an apparatus therefor.

2. Description of the Related Art

There is rapid advancement in the field of display technology. For example, traditional cathode ray tube (CRT) monitors are relatively large and emit a high amount of radiation. They are gradually being replaced by liquid crystal display (LCD) monitors that have the advantages of lower radiation, lower power consumption, and smaller size.

A display panel is composed of multiple pixels in the form of a matrix. When a frame is displayed on a monitor, pixels receive their corresponding pixel-voltage sequentially, according to the pixel-data. The pixel voltage varies according to the pixel data, and according to the variations, frames can be refreshed of different frames can be displayed. If the frame's refresh rate is greater than a certain amount, then what the eyes perceive, due to the effect of temporary visual retention, is not a number of frames flipping through the screen but a continuous display. A greater refresh rate provides a more continuous display, and thereby less flickering that causes discomfort to the eyes. The refresh rate of modern monitors is greater than 60 Hz, which means at least 60 frames are displayed per second.

A pixel of an LCD monitor is the combination of a front plate, a rear plate, and a liquid crystal layer between the front and rear plates. The space between the plates is filled with a number of liquid crystal molecules to form the liquid crystal layer. There are electrodes on both plates, and when applied voltages on the electrodes reaches a certain level, a voltage is formed across the front and rear plates and influences the arrangement of the liquid crystal molecules. Arrangement of the liquid crystal molecules affects the ratio of light permissible through the pixel (light transmissivity). Light transmissivity determines the luminosity of a pixel. The higher light transmissivity is the more luminous a pixel can be. Therefore, by controlling the voltage across the front and rear plates, different luminosity can be assigned to the pixels on the panel.

FIGS. 1A and 1B show pixel luminosity changes according to the pixel voltage. When the input pixel voltage changes, it requires a response time for the theoretical luminosity level to be achieved due to the physical property of the liquid crystal molecules. In FIG. 1A, the input pixel voltage rises from V1 to V2 when frame f2 is displayed. Theoretically, the expected luminosity level of the pixel should be achieved right at the start of the display of f2; the pixel luminosity B1, which corresponds to pixel voltage V1, should rise immediately to the luminosity level B2, which corresponds to pixel voltage V2, shown by the dotted line in FIG. 1B. In reality, it takes a while for the liquid crystal molecules to adapt to their new positions. Therefore, the expected luminosity cannot be achieved until after a certain amount of response time, during which time the crystal liquid molecules are becoming properly aligned. In FIG. 1B, the pixel voltage was changed at the start of f2, but the pixel luminosity cannot reach B2 until f5 is displayed. When a pixel's pixel voltage changes from V1 to V2, the time required to change the pixel luminosity from B1 to B2 is called the pixel response rate. The longer the response time of the liquid crystal molecules, the slower the response rate. Between frames f2 and f5, the actual luminosity is less than the expected value, shown as the area of diagonal lines. The quality of the LCD is thereby degraded. Therefore, the task of how to increase the response rate and decrease the area shown by the diagonal lines when the input pixel voltage changes is important to manufacturers of LCD monitors.

FIGS. 2A and 2B show the traditional technique used to increase the pixel response rate, called overdrive. The traditional technique works by supplying a pixel voltage higher than required in order to shorten the length of time required to build up the voltage across the plate and rear plates, thus increasing the pixel response rate when the pixel luminosity needs to be increased. For example, in FIG. 2A, the input pixel voltage needs to be raised from V1 to V2 in order to raise the luminosity from B1 to B2 when frame f2 is displayed. In order to increase the response rate, a pixel voltage V3, which is higher than V2, is input when frame f2 is displayed. Pixel voltage V3 is called the overdrive voltage herein. By inputting the overdrive voltage, the response rate can be enhanced. The shaded area with diagonal lines in FIG. 2B is smaller than the corresponding shaded area in FIG. 1B. The difference between the pixel's actual luminosity and expected luminosity can be decreased by the use of overdrive voltage.

For the same reason, when the pixel luminosity needs to be decreased, a lower than usual pixel voltage is input, shortening the time required to reduce the voltage across the front and rear plates.

Although the traditional overdrive can increase the pixel response rate, it can only provide limited improvement for the difference between the actual and the expected luminosities.

SUMMARY OF THE INVENTION

It is therefore an object of the invention to provide a method for improving the difference between pixel's actual and expected luminosities by increasing the pixel response rate.

According to the objectives of the present invention, a frame processing method is provided where input frames are sequentially input into a frame processing device at a first refresh rate. The frame processing method includes at least the following steps. First, an input frame is input into the frame processing device. Next, according to the input frame and the previous input frame, the frame processing device determines multiple output frames. After that, the output frames are sequentially output by the frame processing device at a second refresh rate greater than the first refresh rate.

The relationship of the output frame, the input frame, and the previous input frame is pre-stored in the frame processing device. In addition, at least one overdrive output frame is among the output frames. When a pixel datum of the input frame is greater than a corresponding previous pixel datum of the previous frame, the overdrive output frame has a corresponding output pixel datum greater than the pixel datum. When the pixel datum of the input frame is less than the corresponding previous pixel datum of the previous frame, the output pixel datum is less than the pixel datum.

Other objectives, features, and advantages of the invention will become apparent from the following detailed description of the preferred but non-limiting embodiments. The following description is made with reference to the accompanying drawings.

DETAILED DESCRIPTION OF THE INVENTION

The feature of the present invention lies in determining multiple output frames according to the current input frame and the previous frame and enabling the output frames to be displayed sequentially at a higher refresh rate on an LCD panel. The present invention uses the overdrive technique to increase the pixel response rate, and the pixel luminosity is increased to a higher level than the expected luminosity to compensate for the difference between the actual and the expected luminosity levels caused by the response time, thereby improving the display quality of the LCD panel.

Figure 1A:
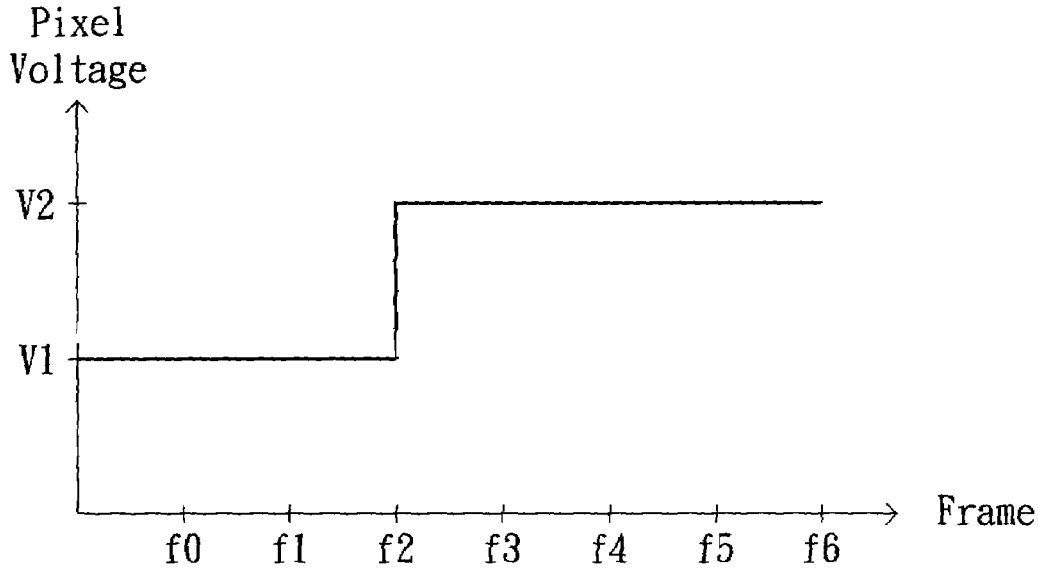
FIG. 1A (PRIOR ART)
FIGS. 1A and 1B (Prior Art) show the dynamics of the luminosity when the pixel voltage varies.
Figure 1B:
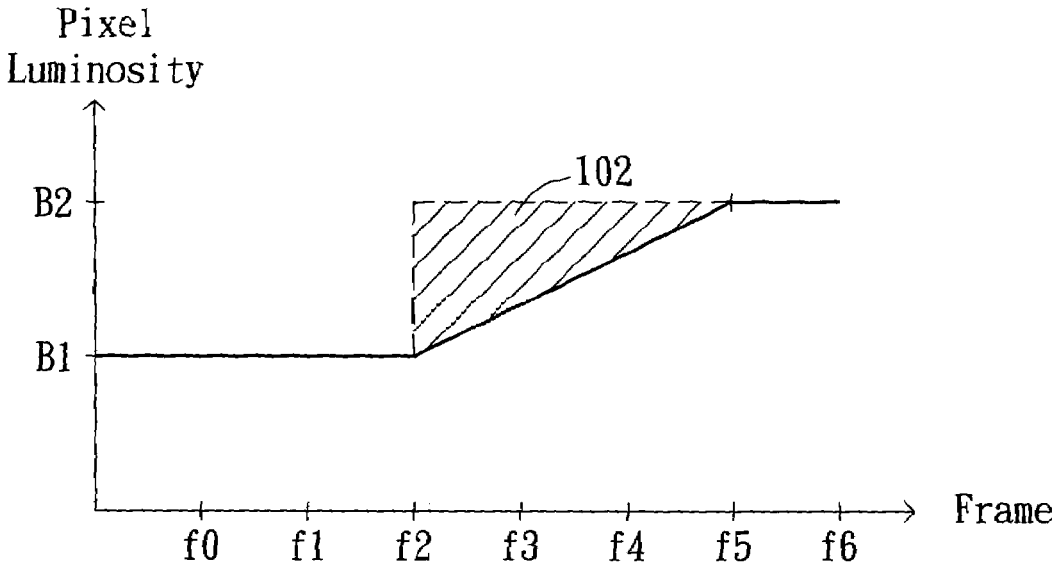
FIG. 1B (PRIOR ART)
Figure 2A:
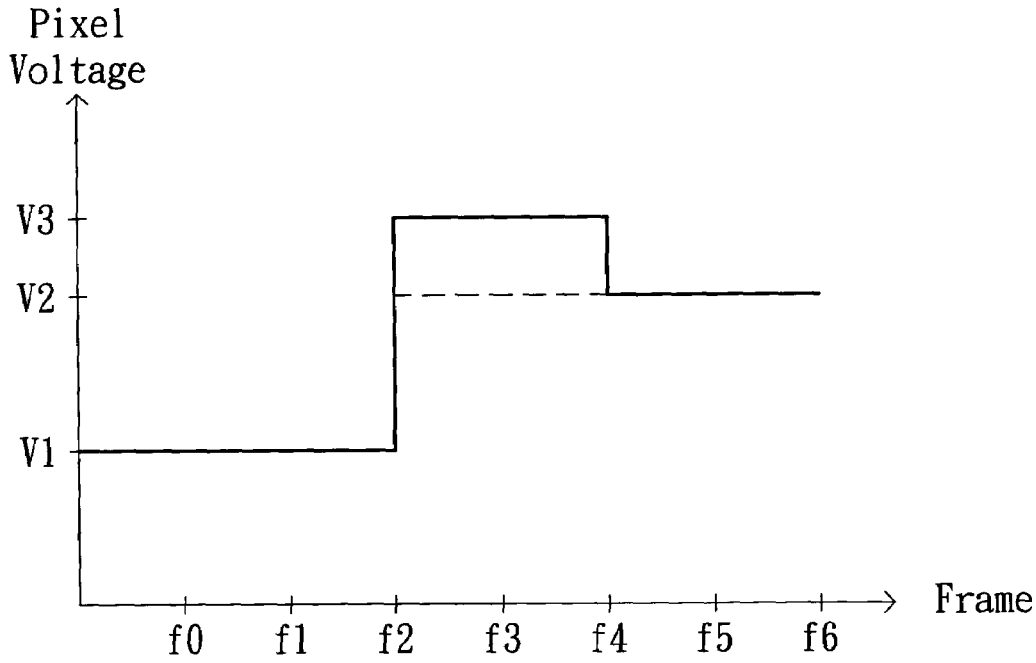
FIG. 2A (PRIOR ART)
FIGS. 2A and 2B (Prior Art) show pixel response rate when the traditional overdrive technique is employed.
Figure 2B:
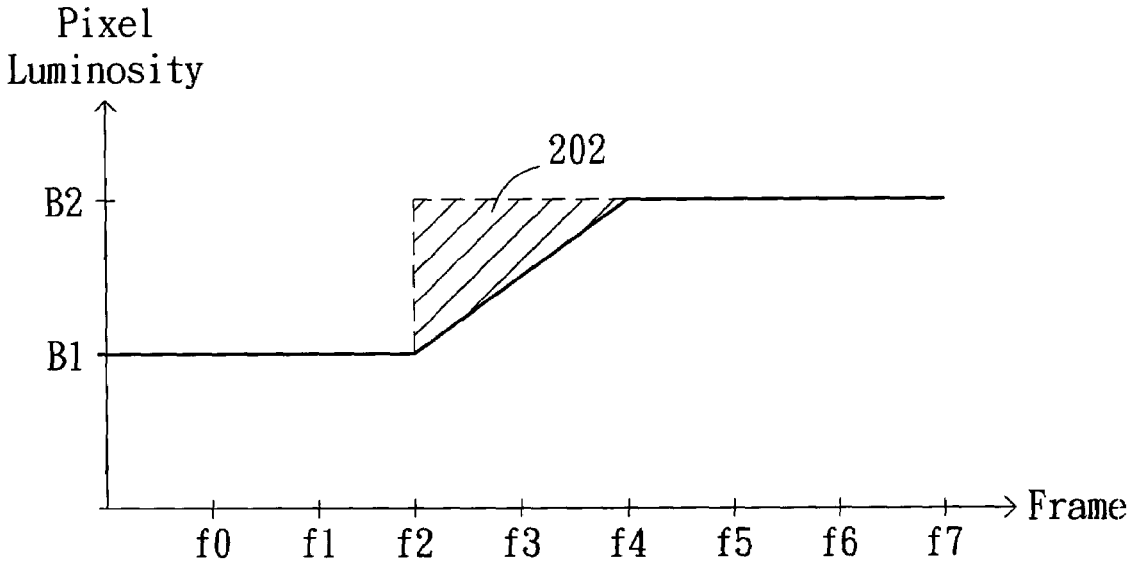
FIG. 2B (PRIOR ART)
Figure 3:
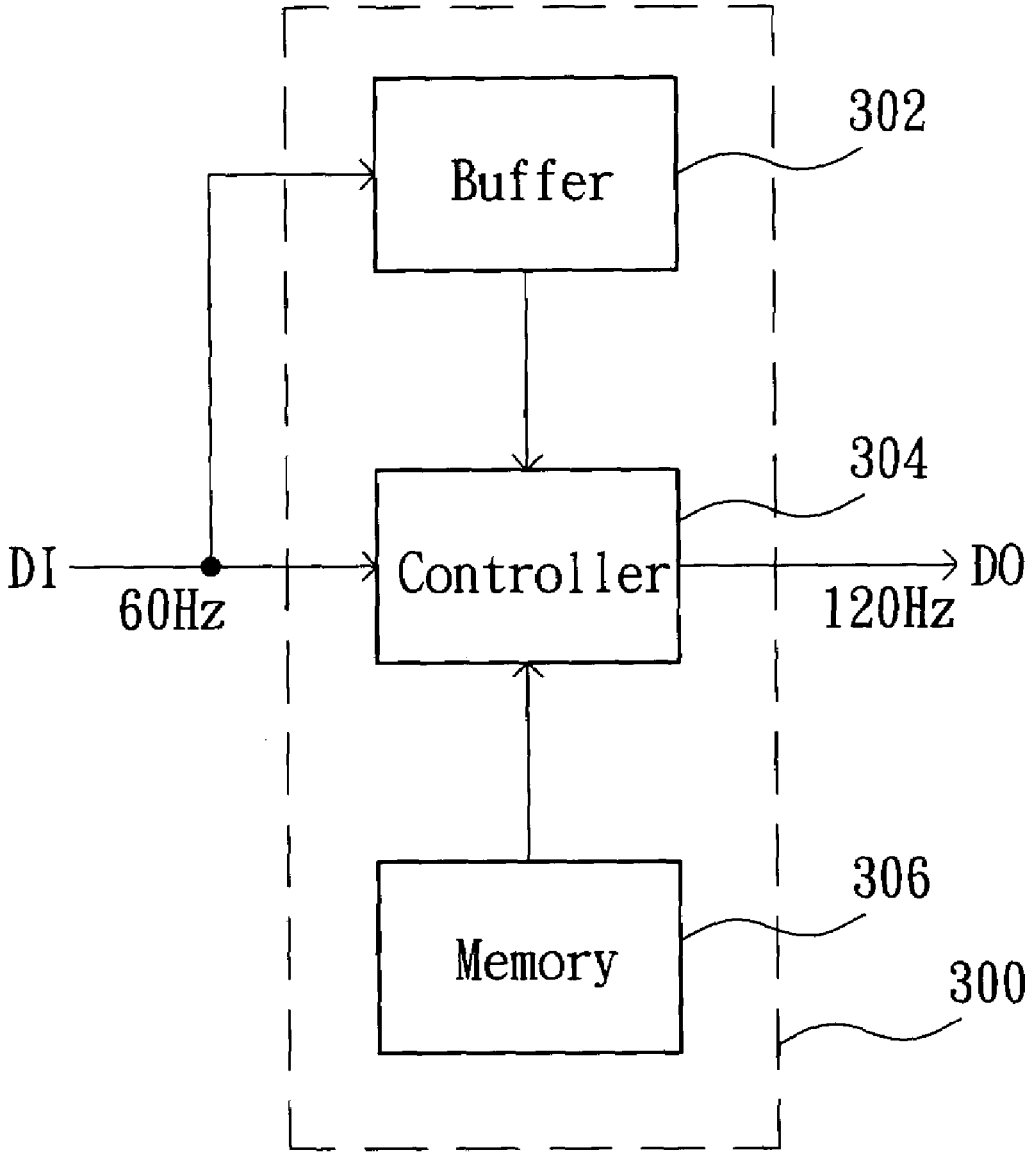
FIG. 3 depicts the circuit diagram of a frame processing device of the present invention.

FIG. 3 depicts the circuit diagram of a frame processor of the present invention. The Frame Processor 300 includes a Buffer 302, a Controller 304, and a Memory device 306, and is used to process the input frames of the LCD panel. A detailed description of how it works is discussed below. Please note that the frames are sequentially input to the Frame Processor 300 at a refresh rate of 60 Hz, for example.

When a frame DI is input to the Frame Processor 300, DI is distributed to both the Buffer 302 and the Controller 304. The Buffer 302 receives and stores the current frame DI and the previous frame DI'. The memory device 306 is, for example, a random access memory (RAM) and records data in a lookup table. The lookup table contains DI (i), DI' (i), and DO (i), wherein DI' (i) is the previous frame of DI (i), and DO (i) is a set which contains multiple output frames corresponding to DI (i), and i is the number of entries in the lookup table. The Controller 304, which is connected to both the Buffer 302 and the memory device 306, retrieves the output frames from the memory device 306 according to the input frame DI and its previous frame DI', and outputs the DO to the LCD panel sequentially at a new refresh rate. The new refresh rate is greater than the refresh rate of the input frame, and it is a multiple of the refresh rate of the input frame, for example. In this embodiment, the refresh rate (120 Hz) of the output frames DO is double the input frame refresh rate (60 Hz), and the output frames are sequentially output to and displayed on the LCD panel at this new refresh rate.

Figure 4A:
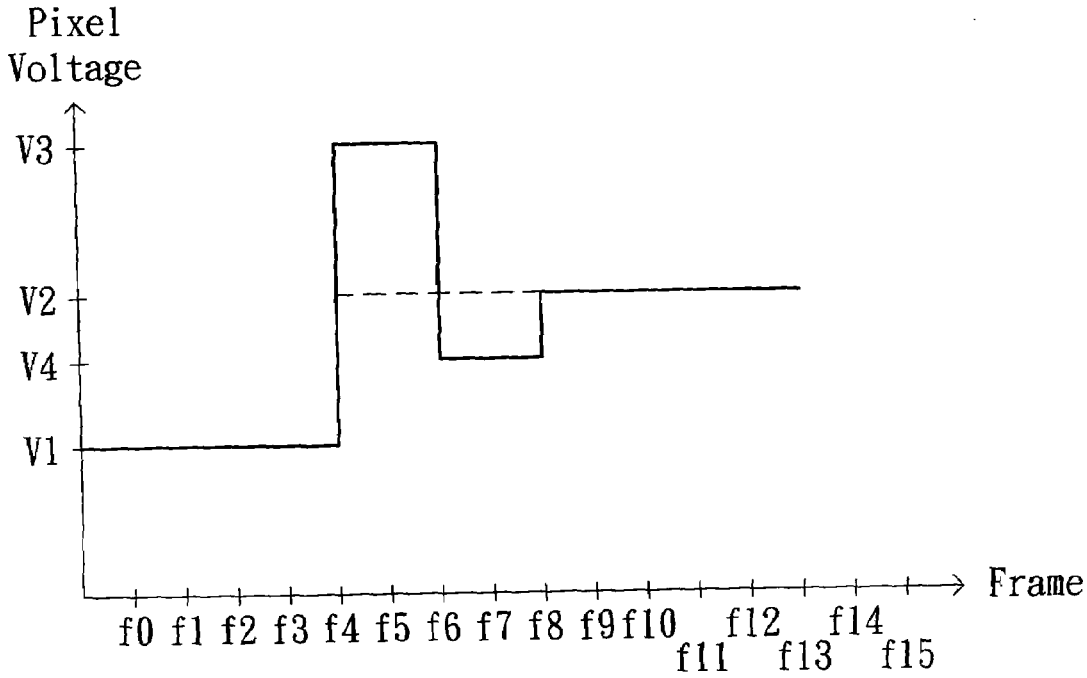
FIGS. 4A and 4B show a frame processing method provided by the present invention.
Figure 4B:
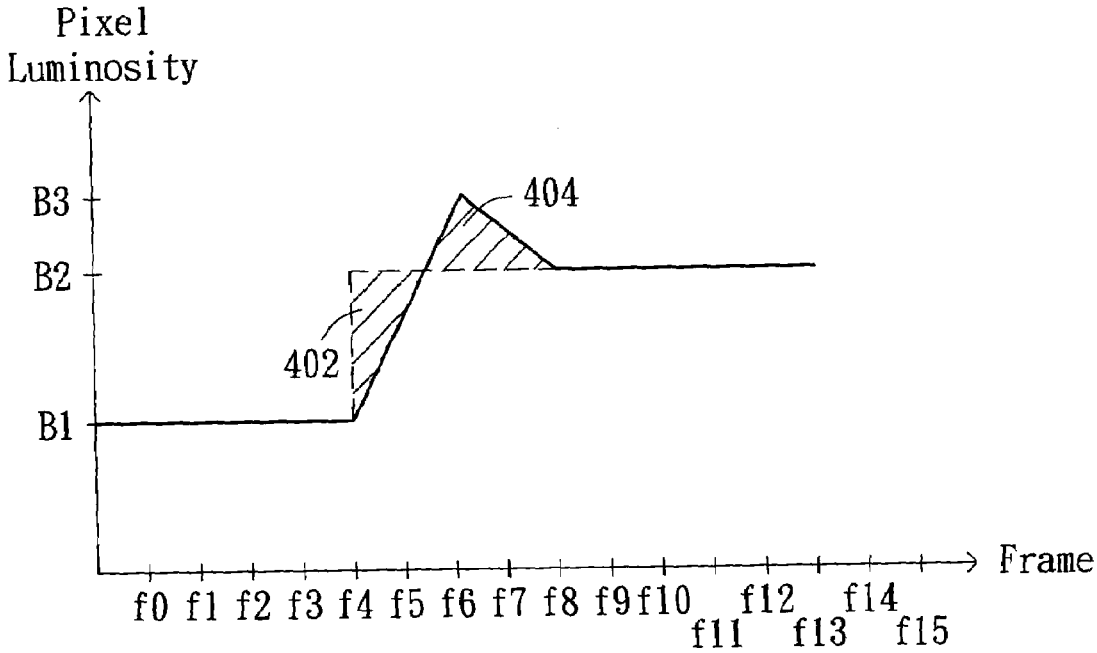

FIGS. 4A and 4B illustrate a frame processing method using the overdrive technique, according to the invention. The present invention employs a higher refresh rate and an overdrive technique to increase the pixel response rate, thereby enhancing the display quality of the LCD panel. For example, the input frame DI input to the Frame Processor 300 has a pixel voltage V2 for driving a pixel in the LCD panel, which has been applied with a pixel voltage V1. If the pixel voltage V2 is greater than the pixel voltage V1, then there is at least one output frame DO having a higher pixel voltage than V2, among all the output frames produced by the Frame Processor 300. The frame processing method will be illustrated in the following embodiment.

In FIG. 4A, the original input pixel voltage to be applied to a pixel is represented by the dotted line as input frames DI are input sequentially while the actual pixel voltage applied to the pixel in the output frames is represented by the solid black line. For example with respect to the voltage to be applied to a certain pixel, the pixel voltage in the input frame DI should theoretically be raised from V1 to V2 if the output frame f4 is to be displayed. In order to increase the pixel response rate, however, the pixel voltage of the output frame f4, V3, which is actually applied to the pixel, is greater than V2. The principle is similar to the overdrive technique and will not be repeated here for the sake of brevity. Please be aware that one or more pixel voltage of the output frame DO can be set to a higher pixel voltage than that of the corresponding input frame DI for the sake of increasing pixel response rate. For example, output frames f4 and f5 in FIG. 4A both have higher pixel voltages than those of the input frames DI. The pixel voltages of f4 and f5 are herein called overdrive voltages.

Subsequently, overdrive compensation voltage needs to be applied during frames f6 and f7. The overdrive compensation voltage has to be lower than the overdrive voltage V3 and even has to be lower than the input voltage V2 which is originally set to drive the pixel. In FIG. 4B, the theoretical luminosity of the pixel is represented by the dotted line, while the actual luminosity displayed is represented by the black solid line. Because of the physical properties of liquid crystal molecules, the technology available today cannot enable the pixel luminosity to vary instantly according to the change in corresponding pixel voltage, such as the change from V1 to V2, as shown in FIG. 4B. The change requires a period of time called the response time. During the response time, the actual luminosity is less than the theoretical one. Regarding to the embodiment, the difference is shown by the shaded area 402 with diagonal lines, as shown in FIG. 4B.

The overdrive technique provided in the present invention differs from the traditional overdrive technique in that the feature of the overdrive technique in the present invention not only increases the pixel response rate, but also raises the pixel luminosity to a higher value than the theoretical value during a certain period of time. During frames f4 and f5 in FIG. 4B, the input frame's overdrive voltage is greater than that of the traditional overdrive technique. Therefore, when frame f6 is displayed, the actual luminosity B3 is greater than the theoretically required luminosity B2. At this time, the overdrive compensation voltage V4 replaces the overdrive voltage V3. And because V4 is smaller than V3, the pixel's luminosity will be gradually reduced. The overdrive compensation voltage V4 is not only smaller than the overdrive voltage V3 but also smaller than the input voltage V2 which is originally set to drive the pixel. Therefore, the overdrive technique of the present invention results in a rate of luminosity reduction greater than that of the traditional overdrive technique. During displaying frame f8, the actual luminosity level has returned to the theoretical luminosity level B2.

By comparing the expected luminosity change (represented by the dotted line) and the actual one (represented by the solid line), as shown in FIG. 4B, the difference between these two luminosity levels can be divided into two sections: a negative luminosity difference section 402 and a positive luminosity difference section 404, both represented as areas with diagonal lines. In the negative luminosity difference section, the actual luminosity of the pixel is less than the theoretical one, and vice versa for the positive luminosity difference section. Because of human physical visual nerve properties, the amount of luminosity perceived in a short time period is the sum of the luminosity changes in the visual field, that is, the integral of the luminosity of the visual field with respect to time within such a short time period. The present invention raises the refresh rate of the frames to a level greater than the response time of human eyes, and raises the actual pixel luminosity to a level greater than the theoretical luminosity by the new overdrive technique. The higher luminosity amount in positive luminosity difference section 404 can compensate for the lower luminosity amount in the negative luminosity difference section 402. When the size of the positive luminosity difference section is substantially equal to the size of the negative luminosity difference section, human eyes cannot perceive the difference between the actual and theoretical luminosities. Therefore, the overdrive technique of the present invention resolves the problem caused by the liquid crystal molecule response time, thus outperforming that of the traditional one. As compared to traditional techniques, the present invention can further improve the display quality of LCD panels.

Figure 5:
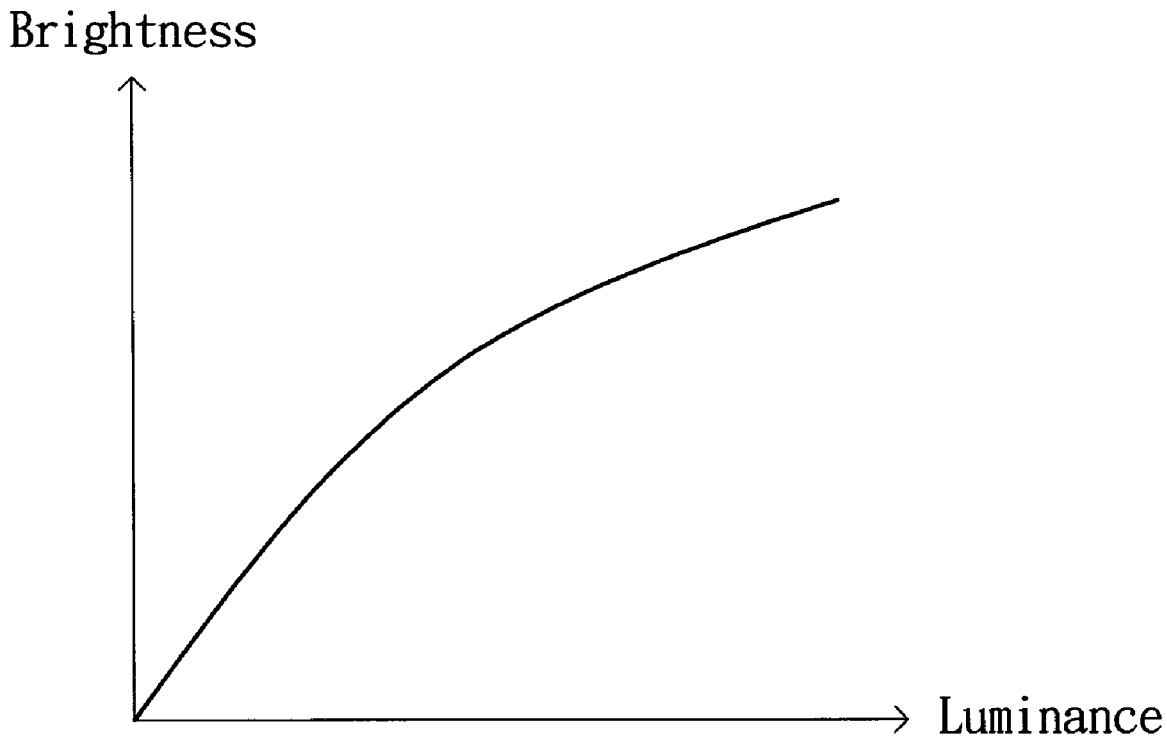
FIG. 5 shows the relationship between the pixel's physical luminance and the brightness perceived by the human eye.

FIG. 5 shows the relationship of the luminance (physical luminosity) and brightness (the amount of luminosity perceived by human eyes), wherein luminance and brightness do not have a linear relationship. Therefore, when determining the pixel voltage for output frames DO according to the lookup table, it is not necessary to exactly match the sizes of the positive luminosity difference section 404 and the negative luminosity difference section 402. However, it is necessary to consider the relationship between the luminance of the pixel and the brightness perceived by human eyes when determining the pixel voltage in the output frames DO so as to make the change of the pixel's expected luminosity correspond to the change of brightness perceived by the eyes.

Please note that the embodiment above exemplifies the technique of the Frame Processor 300 provided in the present invention by changing the pixel luminosity from low to high. When the luminosity needs to be lowered from a higher level, the Frame Processor 300 operates in the similar manner, and the operation in this case will not be described for the sake of brevity.

The frame processing method, which increases the refresh rate of the screen and includes a new overdrive technique, revealed in the present invention can 1) increase a pixel's response rate, 2) compensate for the difference between the actual and theoretical luminosities by raising the display luminosity to a level greater than the theoretical value, and 3) increase the display quality of LCD panels.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of frame processing in which a plurality of frames are sequentially fed into a frame processing device at a first refresh rate, wherein the frame processing device controls a refresh rate of the frames to be displayed in a display device, and the method comprising the steps of:

inputting a first input frame;

inputting a second input frame;

determining a plurality of corresponding output frames according to the first and second input frames with respect to difference in pixel data between the first and second input frames and with respect to a second refresh rate greater than the first refresh rate to increase pixel response rate, wherein the second input frame is input into the frame processing device after the first input frame is input; and outputting the output frames sequentially from the frame processing device at the second refresh rate;

wherein the second input frame includes a second pixel datum, and the first input frame includes a first pixel datum that corresponds to the second pixel datum, and when the second pixel datum is greater than the first pixel datum, the output frames include at least one overdrive output frame and the overdrive output frame includes an output pixel datum which is greater than the second pixel datum; and wherein the output frames have among them an overdrive compensation output frame, which is output from the frame processing device after the overdrive output frame and includes a pixel datum that is smaller than the second pixel datum.

2. The method according to claim 1, wherein the relationship among the first and second input frames and the corresponding output frames with respect to difference in pixel data between the first and second input frames and with respect to the second refresh rate is pre-stored in the frame processing device, and the output frames are determined according to the relationship to increase pixel response rate when the output frames are outputted at the second refresh rate.

3. The method according to claim 1, wherein the second refresh rate is a multiple of the first refresh rate.

4. The method according to claim 1, wherein the overdrive output frame is first output frame output from the frame processing device.

5. The method according to claim 1, wherein the display luminosity of a pixel of the display device according to the output pixel datum is greater than the display luminosity of the pixel according to the second pixel datum.

6. The method according to claim 1, wherein when the second pixel datum of the second input frame is smaller than the first pixel datum of the corresponding first input frame, among all the output frames there is at least one reverse overdrive output frame which has an output pixel datum that is smaller than the second pixel data.

7. The method according to claim 6, wherein the reverse overdrive output frame is the first output frame output from the frame processing device.

8. The method according to claim 6, wherein the display luminosity of a pixel of the display device according to the output pixel datum is less than the display luminosity of the pixel according to the second pixel datum.

9. The method according to claim 6, wherein the output frames further include a reverse overdrive compensation output frame which is output from the frame processing device after the reverse overdrive output frame and includes a pixel datum that is greater than the second pixel datum.

10. The method according to claim 1, wherein the display device is a liquid crystal display (LCD) panel.

11. The method according to claim 10, wherein the relationship between the first and the second input frames, and the output frame is determined by the physical properties of the LCD panel, the luminance of the LCD panel, and the brightness perceived by human eyes.

12. A frame processing apparatus for controlling a plurality of frames to be fed into a display panel, the frame processing apparatus comprising:

a storing component for receiving a first input frame and a second input frame, wherein the first and second frames are input into the storing component at a first refresh rate; and an output component, connected to the storing component, for sequentially outputting a plurality of output frames according to the first and second input frames at a second refresh rate greater than the first refresh rate, wherein the output frames are outputted with respect to difference in pixel data between the first and second input frames and with respect to the second refresh rate to increase pixel response rate;

wherein when a second pixel datum in the second input frame is greater than a corresponding first pixel datum in the first input frame, at least one overdrive output frame is among the output frames and the overdrive output frame includes an output pixel datum, which is greater than the second pixel datum; and wherein the output frames further include an overdrive compensation output frame, which is output from the frame processing apparatus after the overdrive output frame, and the overdrive compensation output frame includes an output pixel datum which is smaller than the second pixel datum.

13. The frame processing apparatus according to claim 12, wherein the output component comprises a memory device which stores a lookup table having entries about the relationship among the output frames and the first and second input frames to increase pixel response rate, and the output component outputs the output frames at the second refresh rate according to the lookup table.

14. The frame processing apparatus according to claim 13, wherein the memory device is a random access memory (RAM).

15. The frame processing apparatus according to claim 12, wherein the second refresh rate is a multiple of the first refresh rate.

16. The frame processing apparatus according to claim 12, wherein the frame processing apparatus outputs the overdrive output frame as the first output frame.

17. The frame processing apparatus according to claim 12, wherein the display luminosity of a pixel of the display panel in accordance with the output pixel datum is greater than the display luminosity of the second pixel datum.

18. The frame processing apparatus according to claim 12, wherein when the second pixel datum in the second input frame is smaller than the corresponding first pixel datum in the first input frame, at least one reverse overdrive output frame is among the output frames, wherein the reverse overdrive output frame includes an output pixel datum that is smaller than the second pixel datum.

19. The frame processing apparatus according to claim 18, wherein the frame processing apparatus outputs the reverse overdrive output frame.

20. The frame processing apparatus according to claim 18, wherein the display luminosity of a pixel of the display panel according to the output pixel datum is less than the display luminosity of the pixel according to the second pixel datum.

21. The frame processing apparatus according to claim 18, wherein the output frames further include a reverse overdrive compensation output frame which is output from the frame processing apparatus after the reverse overdrive output frame, and the reverse overdrive compensation output frame includes an output pixel datum which is greater than the second pixel datum.

22. The frame processing apparatus according to claim 12, wherein the display device is a liquid crystal display (LCD) panel.

23. The frame processing apparatus according to claim 22, wherein the relationship between the first and second input frames, and the output frame is determined by the physical properties of the LCD panel, the luminance of the LCD panel, and the brightness perceived by human eyes.

24. A method of frame processing in which a plurality of frames are sequentially input into a frame processing device at a first refresh rate, wherein the frame processing device controls a refresh rate of the frames to be displayed in a liquid crystal display (LCD) panel, the method comprising the steps of:

inputting a first input frame;

inputting a second input frame;

determining a plurality of corresponding output frames in accordance to the first and second input frames; wherein the second input frame is input into the frame processing device after the first input frame is input and the relationship between the output frames and the first and second input frames is pre-stored in the frame processing device; and outputting the output frames sequentially from the frame processing device at a second refresh rate;

wherein at least one overdrive output frame is among the output frames; when a second pixel datum of the second input frame is greater than a corresponding first pixel datum of the first input frame, a corresponding output pixel datum of the overdrive output frame is greater than the second pixel datum; when the second pixel datum of the second input frame is less than the first pixel datum, the output pixel datum is less than the second pixel; and wherein the output frames have among them an overdrive compensation output frame which is output from the frame processing device after the overdrive output frame, and includes a pixel data that is smaller than the second pixel data when a second pixel datum of the second input frame is greater than a corresponding first pixel datum, and a pixel data that is lamer than the second pixel data when the second pixel datum is smaller than the first pixel datum.

25. The method according to claim 24, wherein the second refresh rate is a multiple of the first refresh rate.

26. The method according to claim 24, wherein the relationship between the first and second input frames and the output frame is determined by the physical properties of the LCD panel, the luminance of the LCD panel, and the brightness perceived by human eyes.

27. The method according to claim 24, wherein when the output pixel datum is greater than the second pixel datum, the luminosity of a pixel, in accordance with the value of the output pixel datum, of the LCD panel is greater than luminosity of the pixel in accordance with the value of the second pixel datum.

28. The method according to claim 24, wherein when the output pixel datum is less than the second pixel datum, the luminosity of a pixel, in accordance with the value of the output pixel datum, of the LCD panel is less than luminosity of the pixel in accordance with the value of the second pixel datum.

* * * * *